United States Patent [19]

Eventoff

[11] 4,451,714

[45] May 29, 1984

[54] SPACERLESS KEYBOARD SWITCH CIRCUIT ASSEMBLY

[76] Inventor: Franklin N. Eventoff, 2351 Lake View Ave., Los Angeles, Calif. 90039

[21] Appl. No.: 465,088

[22] Filed: Feb. 9, 1983

[51] Int. Cl.[3] ..... H01H 13/70

[52] U.S. Cl. ..... 200/5 A; 200/86 R; 200/159 B; 200/267; 200/292; 361/398

[58] Field of Search ..... 200/16 B, 16 C, 16 D, 200/275, 267, 292, 5 A, 159 B, 86 R; 361/398; 338/114, 99, 69

[56] References Cited

U.S. PATENT DOCUMENTS

| | | | |
|---|---|---|---|
| 3,383,487 | 5/1968 | Wiener | 200/5 A X |
| 3,987,259 | 10/1976 | Larson | 200/5 A |
| 3,996,430 | 12/1976 | Eberwein et al. | 200/5 A |
| 4,066,851 | 1/1978 | White et al. | 361/398 X |
| 4,145,584 | 3/1979 | Otterlei | 361/398 X |
| 4,287,394 | 1/1981 | Hargita et al. | 200/5 A |
| 4,301,337 | 11/1981 | Eventoff | 200/5 A |

*Primary Examiner*—J. R. Scott

*Attorney, Agent, or Firm*—Nilsson, Robbins, Dalgarn, Berliner, Carson & Wurst

[57] ABSTRACT

A spacerless switch circuit for use in multiple switch keyboards includes a first base member having a front surface and a second base member having a front surface in touching relationship against the front surface of the first base member. A plurality of first and second conductor traces are respectively deposited on the front surfaces of the first and second base members. An insulative layer is deposited over regions of either or both of the first and second conductor traces to insulate the conductor traces from each other when the front surfaces of the two base members are touching one another. One or more first switch contacts are deposited on the first base member and one or more facing second switch contacts are deposited on the second base member to define one or more on/off switches. At least one of the first switch contacts includes a first conductive pad and a first pressure sensitive layer applied over the first conductor pad so that a surface junction is formed between the first and second switch contacts where the surface junction is electrically nonconductive when the first contact noncompressively touches the facing second contact and is electrically conductive when the first contact compressively touches the facing second contact.

16 Claims, 4 Drawing Figures

SPACERLESS KEYBOARD SWITCH CIRCUIT ASSEMBLY

BACKGROUND OF THE INVENTION

The present invention relates to switching circuits and in particular to switching circuit assemblies without spacers to effect electrical isolation between opposing circuit traces and switch contacts.

Keyboard switch assemblies have been used for a number of years in numerous different applications such as keyboards for computer games, calculators, computer terminals and the like. Typically, such keyboards include a number of switches each of which has one contact which is physically moved into touching relationship with another contact to affect the conduction across the junction between the two contacts.

Keyboards having a number of such switches have been constructed from mechanical components such as springs and the like. Typically, such keyboards are costly to manufacture and are subject to premature failure. Consequently, keyboards have been developed which minimize or even eliminate most mechanical components. Typical of such keyboards is the keyboard switch assembly disclosed in White et al., U.S. Pat. No. 4,066,851. The disclosed keyboard construction uses a sheet of flexible, resilient, nonconductive material on which is disposed a number of conductor traces and conductor pads. The flexible sheet is then folded with a suitable spacer positioned between the halves of the folded sheet to prevent shorting by the traces and to maintain the facing switch contacts in spaced apart relationship to prevent shorting and hence nonfunctioning of the switches. The operation of the keyboard requires the depression of one contact into touching relationship to the facing contact to turn the switch on.

In switches like the one disclosed in White et al., a spacer has been required with the switch contacts made of a purely conductive material. The requirement for a spacer entails significant additional materials cost as well as assembly cost since the spacer must be manually inserted between the two halves of the flexible base on which the conductor tracers and switch contacts are deposited.

By contrast, the present invention eliminates the need for a spacer and therefore eliminates the additional assembly step and the expense of inserting a spacer between the two halves of the flexible plastic base material. Furthermore, the present invention eliminates the need for the fabrication of special protrusions to maintain one switch contact in spaced apart relationship to the other switch contacts.

Indeed, in accordance with the present invention, a keyboard switch assembly is constructed in a manner which enables the two halves of the base member on which the circuit tracers and switch contacts are disposed to be positioned opposite one another in touching relationship without affecting the operation of the switches and without causing shorting of oppositely disposed circuit traces. Furthermore, the switch contacts may also be touching one another so long as the touching is noncompressive because of the pressure sensitive layer used to cover at least one of the switch contacts.

Such a configuration is possible by silk screening an insulative resin compound to cover the portion of the conductor traces which would otherwise come in contact with other conductor traces when the two halves of the base member are brought into touching relationship to each other.

Similarly, the pressure sensitive layer is applied using suitable silk screen techniques where the pressure sensitive layer includes a semiconducting material such as particulate molybdenum disulfide which forms an exposed surface with a multiplicity of microprotrusions extending therefrom. It has been found that using such a layer with the multiplicity of microprotrusions on its surface will cause a surface junction between the exposed surface and the oppositely positioned switch contact which has an extremely high resistance so as to allow, at most, insignificant conduction when the touching is noncompressive. On the other hand, as the switch contacts are pressed together, conduction begins and increases in proportion to the amount of force applied. Thus, the keyboard switch assembly in accordance with the invention provides not only an on-off switch but also provides a variable resistance switch which is pressure sensitive. The particular spacerless switch construction in accordance with the invention is disclosed in Eventoff, U.S. Pat. No. 4,315,238 issued Feb. 9, 1982 which application is hereby incorporated by reference.

SUMMARY OF THE INVENTION

A keyboard switch assembly in accordance with the invention comprises a first base member having a front surface and a second base member having a front surface positioned in noncompressive touching relationship against the front surface of the first base member. At least one first conductive trace is then deposited by suitable means such as by silk screening or spraying, on the front surface of the first base member. Similarly, at least one second conductive trace is disposed on the front surface of the second base member. An insulative layer is then deposited to cover at least one region of one of the first and second conductor traces to insulate the first conductor traces from shorting out against the second conductor traces when the front surfaces of the first and second base members are positioned in touching relationship against each other.

At least one first switch contact is disposed on the first base member where each first switch contact comprises a first conductive pad which is applied to the front surface of the first base member and is electrically coupled to at least one of the first conductive traces. Each first switch contact further comprises a first pressure sensitive layer which is applied by silk screening or the like over the first conductive pad. The first pressure sensitive layer comprises a semiconducting material in intimate electrically conducting contact with the first conductor pad with the first semiconductor layer defining a first exposed surface with a multiplicity of microprotrusions extending therefrom for defining a multiplicity of surface contact locations on the first exposed surface.

At least one second switch contact is further provided on the second base member where each second switch contact is electrically coupled to at least one of the second conductor traces and is physically positioned to face at least one first switch contact when the first base member is positioned in touching relationship against the second base member. Hence, each switch of the keyboard switch circuit is defined by a first switch contact having a first exposed surface which is or at least may be in noncompressive touching contact with a facing second switch contact. The point of contact between the first exposed surface of the first switch contact and the surface of the second switch contact defines a surface junction which is essentially electrically nonconductive when the first exposed surface noncompressively touches the facing second contact and is electrically conductive when the first exposed surface compressively touching the facing second contact.

In a preferred embodiment of the invention, the base member is a single member which is folded along the fold line. However, the base member may be two separate members which are aligned in facing relationship to each other by suitable means such as alignment pins or the like. It is also preferable that the base member be made of a flexible plastic material such as Mylar or the like to facilitate the independent operation of the multiple switches on a keyboard configured in accordance with the invention.

In another embodiment of the invention, the second facing switch contact may, like the first switch contacts, include a pressure sensitive layer which has a second exposed surface where the junction between the first exposed surface and the second exposed surface of the respective pressure sensitive layers covering the respective switch contacts define the surface junction.

BRIEF DESCRIPTION OF THE DRAWINGS

A complete understanding of the present invention and of the above features may be gained from a consideration of the following description of the preferred embodiments taken in conjunction with the accompanying drawings in which.

DETAILED DESCRIPTION

Figure 1:
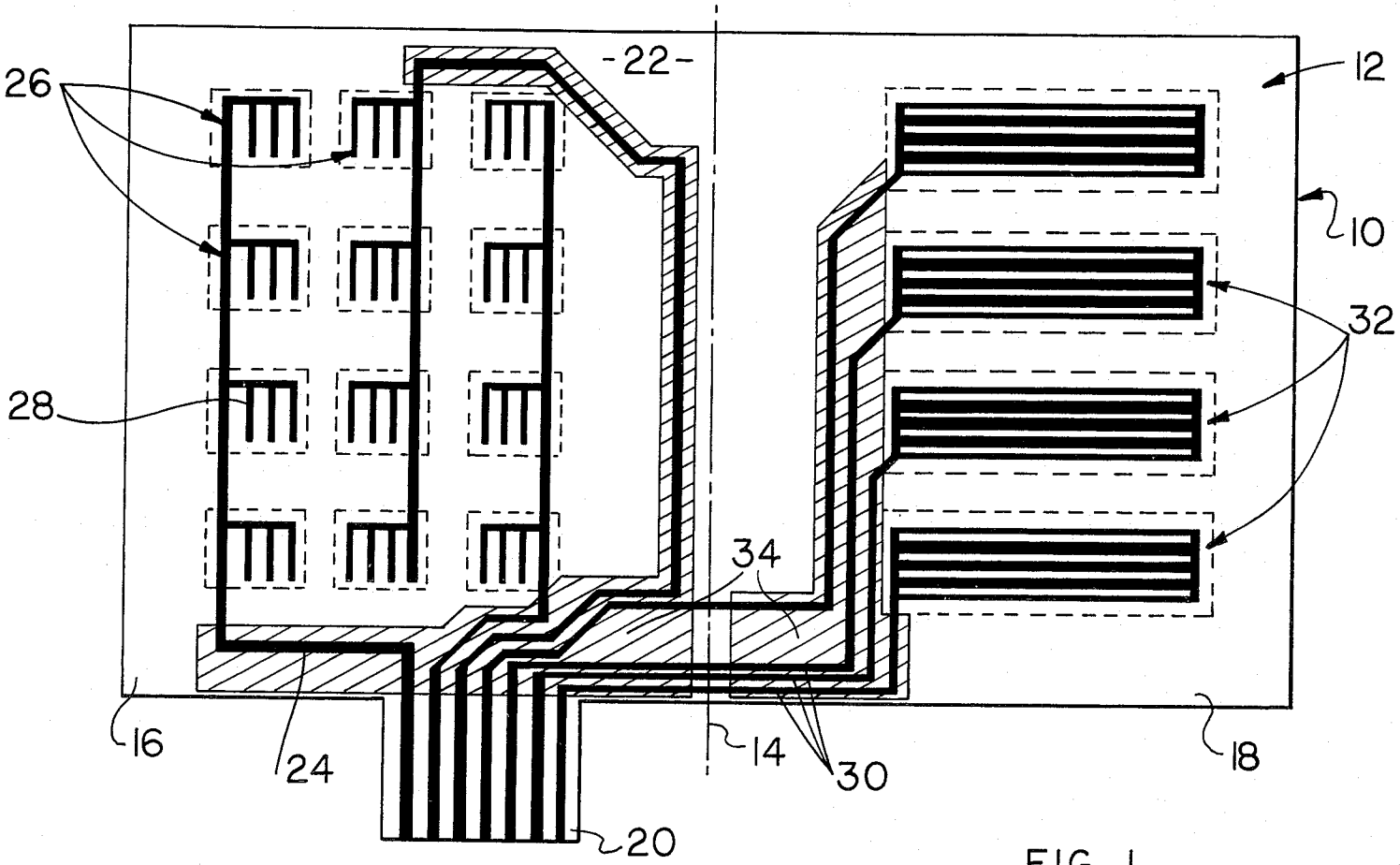
FIG. 1 is a top view of a keyboard configuration in accordance with the invention in the unfolded state.
Figure 2:
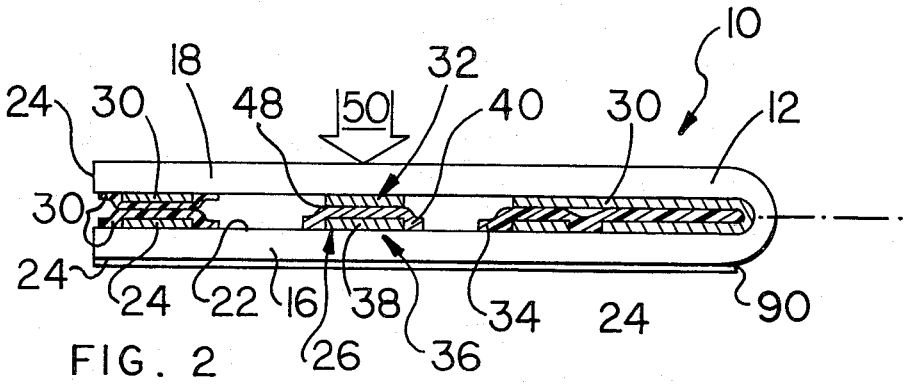
FIG. 2 is a cross-sectional side view of a keyboard construction in accordance with the invention which shows a single switch on a unitary folded base member.

Referring to FIG. 1 in conjunction with FIG. 2, a switch device 10 in accordance with the invention comprises a unitary base member 12 divided along a fold line 14 into a first section 16 and a second section 18. The first section 16 may have a connector tail 20 extending therefrom to provide a means of access whereby the conductor traces to be described can be electrically coupled to an electronic circuit (not shown). The base member 12 is preferably a thin sheet of Mylar or other similar insulating material with a front surface 22 and a back surface 24 so that the base member 12 can be folded along the fold line 14 to bring the portion of the front surface 22 on the first section 16 and the portion of the front surface 22 on the second section 18 into the actual or potential touching relationship.

One or more first conductor traces 24 are provided on the front surface 22 to extend over the connector tail 20 and across the first section 16 along one or more preselected paths. Each first conductor trace 24 terminates in one or more switch contacts 26 likewise disposed on the front surface 22 on the first section 16. Each first switch contact 26 may comprise a plurality of contact fingers 28 to facilitate making electrical contact.

The switch device 10 also includes one or more second conductor traces 30 on the front surface 22 which extend from the connector tail 20 along a region of the first section 16, across the fold line 14, and along predefined paths on the second section 18. Each second conductor trace 30 terminates in one or more second switch contacts 32 which are located on the second section 18 in such a manner that when the second section 18 and the first section 16 are folded together along the fold line 14 each second switch contact 32 will overlay three different first switch contacts 26. Conversely, each of the electrically coupled first switch contacts 26 will overlay four different second switch contacts 32 so that in the illustrated arrangement, a matrix of 12 different switches are provided.

Of course, it will be appreciated that the present invention is not limited to the specific matrix like contact arrangement shown in FIG. 1 but may include any other switch arrangement whereby at least one switch contact on the second section 18 will be located in such a way as to physically touch one switch contact on the first section 16 when the base member 12 is folded along the fold line 14.

In accordance with the invention, the first switch contacts 26 comprise extensions of the first conductor traces 24 and the switch contacts 32 comprise extensions of the second conductor traces 30. The respective conductor traces and switch contacts can therefore be formed at the same time by, for example, a silk screen process whereby a composition containing a conductive particulate material such as silver is silk screened onto the front surface 22 along predefined paths. Alternatively, the conductive composition used for the conductor traces and the switch contacts may be applied by first placing a mask over the front surface 22 to cover all but selected regions of the front surface 22 and thereafter spraying the conductive composition onto the front surface 22 in the unmasked regions.

Of course, any other deposition technique may be used to form the respective first and second conductor traces and the first and second switch contacts without departing from the invention in its broadest aspects.

Heretofore, switching devices made by folding one section containing conductive traces into facing relationship against a second section containing conductive traces have required the use of physical spacers to prevent portions of the conductor traces on the first section from shorting out against portions of the conductor traces on the second section and also to assure that switch contacts on one section of the base were to be normally noncontacting and hence non-conducting relationship with the switch contacts on the second section of the base. To allow one switch contact to be in continuous touching relationship to the other switch contact would result in a nonfunctional switch because the switch would always in the conducting state. The use of such spacers increased costs in terms of both materials and assembly time. However, in accordance with the present invention all such spacers have been eliminated and it is now possible to allow the switch contacts to be in continuous touching relationship without affecting the operation of the switch.

Referring further to FIGS. 1 and 2, to achieve this improved switch device in accordance with the invention, selected regions of the first section 16 or the second section 18 or both, across which the first conductor traces 24 and the second conductor traces 30 extend are covered with an insulative layer 34. Thus, those regions of the first conductor traces 24 which will overlay portions of the second conductor traces 30 when the first section 16 and the second section 18 are folded into touching relationship will have at least a single insulative layer and optionally a double insulated layer between the facing conductor traces to prevent shorting. In accordance with the invention, the insulative layer 34 may be applied in much the same manner as the respective first and second conductor traces 24 and 30 are applied to the front surface 22 of the base member 12. Specifically, the insulative layer 34 may be formed by a silk screen process whereby an insulative plastic resin material may be applied over selected regions of the base member 12 to cover selected portions of the first conductor traces 24, second conductor traces 30 or both. Numerous suitable insulative resins are commercially available.

Figure 3:
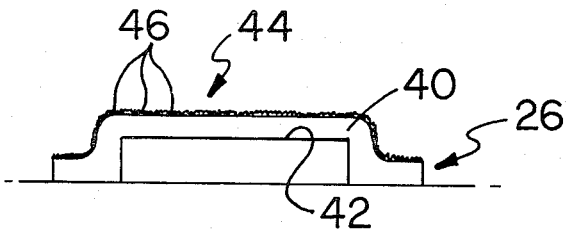
FIG. 3 is a detail of a first switch contact with the pressure sensitive layer.

Referring now more particularly to FIG. 2, a cross section of the construction of the keyboard switch circuit 10 is illustrated whereby a first switch contact 26 faces a second switch contact 32 to define a switch 36. Referring additionally to FIG. 3, at least one of the first and second switch contacts 26 and 32 respectively, comprises a conductor ply 38 which is the aforementioned extension of one of the first conductor traces 24. Disposed to cover the conductor composition ply 38 is a very thin pressure sensitive layer 40 such as a composition comprising a mixture of a particulated semiconducting material such as molybdenum disulfide, a binder such as a resin material, and a binder solvent or thinner to enable the mixture to be thinned to the proper consistency for application by either spraying or silk screening. Such a composition is described in Eventoff, U.S. Pat. No. 4,314,227 issued Feb. 2, 1982 and Eventoff, U.S. Pat. No. 4,315,238 issued Feb. 9, 1982, each of which patents are hereby incorporated by reference.

In accordance with the invention, the pressure sensitive material is applied over selected regions of the first section 16 or the second section 18 or both the first section 16 and the second section 18 so as to provide a pressure sensitive layer between each first switch contact 26 and the corresponding facing second switch contact 32. The pressure sensitive material may be applied by silk screening, spraying in nonmasked areas or any other suitable technique. The resultant pressure sensitive layer then comprises a semiconducting material such as particulated molybdenum disulfide which is in intimate electrically conducting contact with the conductor composition ply 38 as illustrated in FIG. 3 by the contact region 42. The pressure sensitive layer 40 has an exposed surface 44 which has a multiplicity of microprotrusions 46 of the semiconducting particulate material to form a multiplicity of surface contact locations.

When the second section 18 is positioned in facing relationship to the first section 16, the second switch contact 32 in FIG. 2 can come into touching relationship to the multiplicity of surface contact locations provided by the microprotrusions 46. However, such touching will be noncompressive. It has been found that such noncompressive touching of the second switch contact 32 to the first exposed surface 44 will not short out the switch and indeed will define a surface junction 48 between the first exposed surface 44 and the second switch contact 32 which will be electrically nonconductive when the second switch contact 32 non-compressively touches the first exposed surface 44. As used herein, reference to "electrically nonconductive" in connection with noncompressive touching of the switch contacts means a junction resistance which is infinite or so large that at most only functionally insignificant current conducts across the junction.

On the other hand, when a compressive force 50 is applied against the back surface 24 of the base member 12 in a manner which forces the second switch contact 32 against the first exposed surface 44, significant conduction across the surface junction 48 will commence and increase as the compressive force 50 increases.

It can therefore be seen that the present invention provides a switch device which may include one or a multiplicity of switches where the circuit traces connecting the various switch contacts are insulated from each other to prevent shorting by the application of a insulative composition layer and the switch contacts may be in noncompressive touching contact with each other while still maintaining an essentially nonconductive junction between the switch contacts to thereby provide a simple switch device construction without the need of spacers.

Figure 4:
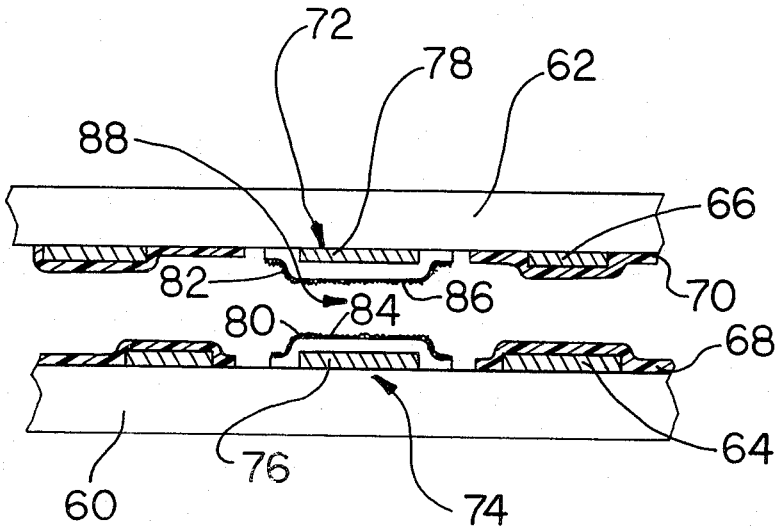
FIG. 4 is an exploded cross-sectional side view illustrative of a second embodiment of the invention which includes a bifurcated base member with a pressure sensitive layer disposed over each of the first and second switch contacts.

Referring to FIG. 4, another embodiment of the invention is illustrated wherein the base member 12 need not be a single unitary member which is folded but may comprise a first base member 60 and a second base member 62. The first base member 60 may be rigid or flexible as may the second base member 62. Additionally, the first base member 60 may be of a flexible material such as Mylar while the second base member 62 may be of a rigid nonflexible material. The first base member 60 and the second base member 62 may be coupled together by a hinge, by adhesive or by any other means so that a "fold line" like the fold line illustrated in FIG. 1 exists or alternatively the first and second base members 60 and 62 may be separate but aligned with pins or by other suitable means.

In accordance with the embodiment illustrated in FIG. 4, first conductor traces 64 and second conductor traces 66 are covered by insulative layers 68 and 70 respectively. Also, both first and second switch contacts 72 and 74 have the same construction as the first switch contact 26 of FIGS. 2 and 3. Specifically, both the first and second switch contact 72 and 74 have conductor pads 76 and 78 respectively, and pressure sensitive composition layers 80 and 82 respectively to form first and second exposed surfaces 84 and 86 respectively. The junction between the first and second exposed surfaces 84 and 86 define the surface junction 88 which is insulative wherein noncompressively touching relationship but becomes increasingly conducting in the presence of increased compressive touching between the two surfaces 84 and 86.

Various modifications and variations can be made in the above-described construction without departing from the spirit of the present invention. For example, as illustrated in FIG. 2, part of the back surface 24 of the base member 12 may be covered by a conductive layer to provide a ground plane 90 whereby static electricity is grounded and does not affect operation of the switch device 10. Also, various layers having protrusions or other mechanical configurations to give the user a "feel" of depressing a switch may be added.

While specific embodiments of the invention have been particularly described it will be appreciated that various changes and modifications can be made without departing from the spirit of the invention in its broadest aspects and it is the object of the following claims to cover all such modifications and variations as fall within the true scope of the invention.

What is claimed is:

1. A switch circuit assembly comprising:

a unitary base member having a front surface and having a fold line for dividing the base member into a first section and a second section;

a plurality of first conductor traces on the front surface of the base member extending along preselected paths on the first section;

a plurality of second conductor traces on the front surface of the base member extending along preselected paths on the first section, across the fold line and along the second section;

at least one first switch contact on the front surface of the base member on the first section, each first switch contact electrically coupled to at least one of the first conductor traces;

at least one second switch contact on the front surface of the base member on the second section, each second switch contact electrically coupled to at least one of the second traces, each first switch contact being located to face at least one of the second switch contacts when the base member is folded along the fold line;

an insulative layer applied over selected regions of the base member to cover selected regions of at least one of the first and second conductor traces to insulate the first conductor traces from the second conductor traces when the base member is folded with the first and second sections in touching relationship to each other;

each of the switch contacts on at least one of the first and second sections comprising;

a conductor ply, and a pressure sensitive layer applied over the conductor ply, the pressure sensitive layer comprising a semiconducting material applied to be in intimate electrically conducting contact with the conductor ply, the pressure sensitive layer defining a first exposed surface with a multiplicity of microprotrusions of the semiconducting material extending therefrom for providing a multiplicity of surface contact locations, the other of the first and second contacts facing the first exposed surface defining at least one facing contact, the junction between the first exposed surface and its facing contact defining a surface junction, said surface junction being electrically non-conductive when the first exposed surface noncompressively touches the facing contact and being conductive when the first exposed surface compressively touches the facing contact.

2. The circuit of claim 1 wherein each switch contact on both the first and second sections comprise said conductor ply and said pressure sensitive layer applied over the conductor composition ply.

3. The circuit of claim 1 wherein the semiconducting material is selected so that conduction across the surface junction increases as the force of compressive touching between the first exposed surface and the facing contact increases.

4. The circuit of claim 2 wherein the semiconducting material is selected so that conduction across the surface junction increases as the force of compressive touching between the first exposed surface and the facing contact increases.

5. The circuit of claim 1 wherein the insulative layer comprises a nonconductive silk screened resin layer.

6. The circuit of claim 1 wherein the unitary base member comprises a flexible plastic sheet.

7. The circuit of claim 1 wherein the semiconducting material is particulated molybdenum disulfide.

8. The circuit of claim 1 wherein the insulative layer is applied to cover selected regions of both the first and second conductor traces.

9. The circuit of claim 8 wherein at least some of the selected regions on the first section are located to be in facing contact with other of the selected regions on the second section when the base member is folded to bring the first and second sections into touching relationships with each other whereby a double insulative layer is provided between facing regions of the first and second conductor traces.

10. A switch circuit assembly comprising:

a first base member having a front surface;

a second base member having a front surface positioned in noncompressive touching relationship against the front surface of the first base member;

at least one first conductor trace on the front surface of the first base member;

at least one second conductor trace on the front surface of the second base member;

an insulative layer covering at least a region of one of the first and second conductor traces for insulating the first conductor traces from the facing second conductor traces;

at least one first switch contact on the first base member, each first switch contact comprising:

a first conductor pad applied to the front surface of the first base member and electrically coupled to at least one of the first conductor traces; and a first pressure sensitive layer applied over the first conductor pad, the first pressure sensitive layer comprising a semiconducting material applied to be in intimate electrically conducting contact with the first conductor pad and having a first exposed surface with a multiplicity of microprotrusions of the semiconducting material extending therefrom for defining a multiplicity of surface contact locations;

at least one second switch contact on the second base member electrically coupled to at least one of the second conductor traces and positioned to face at least one first switch contact when the front surface of the first base member is positioned against the front surface of the second base member, the region between the first exposed surface and the facing second switch contact defining a surface junction, the surface junction being functionally electrically non-conductive when the first exposed surface noncompressively touches the facing second contact and being electrically conductive when the first exposed surface compressively touches the facing second contact.

11. The circuit of claim 10 wherein the first base member and the second base member are joined together along a fold line to form a single overlaid base member.

12. The circuit of claim 10 wherein at least one of the first and second base members is a flexible plastic sheet.

13. The circuit of claim 10 wherein each second switch contact comprises:

a second conductor pad applied to the front surface of the second base member and electrically coupled to at least one of the second conductor traces; and a second pressure sensitive layer applied over the second conductor pad, the second pressure sensitive layer comprising the semiconducting material applied to be in intimate electrically conducting contact with the second conductor pad and having a second exposed surface with a multiplicity of microprotrusions of the semiconducting material extending therefrom for defining a multiplicity of surface contact locations, the surface junction being the junction between the first and second exposed surfaces.

14. The circuit of claim 13 wherein the semiconducting material is selected so that conduction across the surface junction increases as the force of compressive touching between the first and second exposed surfaces increases.

15. The circuit of claim 10 wherein the semiconducting material is particulated molybdenum disulfide.

16. The circuit of claim 10 wherein the insulative layer is applied to cover selected regions of both the first and second conductor traces.

* * * * *